US007007985B2

(12) United States Patent
Alexander et al.

(10) Patent No.: US 7,007,985 B2
(45) Date of Patent: Mar. 7, 2006

(54) AUTOMATIC DEADBOLT MECHANISM FOR A MORTISE LOCK

(75) Inventors: Arnon Alexander, Marietta, GA (US); Jonathan Payne, Lawrenceville, GA (US); Ramon Torres Valladolid, Jalisco (MX); Vincente Rodriguez Barrera, Jalisco (MX)

(73) Assignee: Onity, Inc., Norcross, GA (US)

( * ) Notice: Subject to any disclaimer, the term of this patent is extended or adjusted under 35 U.S.C. 154(b) by 14 days.

(21) Appl. No.: 10/648,665

(22) Filed: Aug. 26, 2003

(65) Prior Publication Data

US 2005/0046198 A1 Mar. 3, 2005

(51) Int. Cl.
*E05C 1/08* (2006.01)

(52) U.S. Cl. ..... 292/163; 292/169.14; 292/332; 292/335; 292/DIG. 21; 70/107; 70/151 R; 70/486

(58) Field of Classification Search ..... 292/163, 292/169.14, 332, 335, DIG. 21, 336; 70/107, 70/151 R, 486, DIG. 6
See application file for complete search history.

(56) References Cited

U.S. PATENT DOCUMENTS 3,242,706 A * 3/1966 Check ..... 70/110
3,361,462 A * 1/1968 Foster ..... 292/165
3,672,714 A * 6/1972 Schultz ..... 292/34
3,750,433 A * 8/1973 Sanders ..... 70/486
3,769,822 A * 11/1973 Yulkowski ..... 70/107
3,808,849 A * 5/1974 Alexander ..... 70/149
3,894,417 A 7/1975 Taniyama
4,071,270 A * 1/1978 Alexander ..... 292/169.22
4,118,056 A * 10/1978 Alexander ..... 292/169.17
4,389,061 A * 6/1983 Foshee ..... 292/169.14
4,583,382 A * 4/1986 Hull ..... 70/107
4,674,776 A * 6/1987 James ..... 292/40
4,754,625 A 7/1988 McGourty et al.
4,840,050 A * 6/1989 Gotanda ..... 70/107
4,890,870 A * 1/1990 Miron ..... 292/333

(Continued)

*Primary Examiner*—Brian E. Glessner
*Assistant Examiner*—Carlos Lugo
(74) *Attorney, Agent, or Firm*—Akin Gump Strauss Hauer & Feld, LLP

(57) ABSTRACT

An automatic mechanism and method for moving a deadbolt between a retracted deadbolt position and an extended deadbolt position. A trigger is operatively coupled to the deadbolt and to the auxiliary latch. The trigger is configured to cause a first movement of the deadbolt from the retracted deadbolt position to the extended deadbolt position when the trigger moves from a first trigger position to a second trigger position, and to require movement of the auxiliary latch a predetermined distance from a retracted auxiliary-latch position toward an extended auxiliary-latch position before the trigger is able to cause a second movement of the deadbolt. The method includes as a step preventing the deadbolt from being released from the retracted deadbolt position until the auxiliary latch has moved a predetermined distance from the retracted auxiliary-latch position toward the extended auxiliary-latch position.

3 Claims, 11 Drawing Sheets

U.S. PATENT DOCUMENTS 4,950,005 A * 8/1990 Cudd ..... 292/150
5,010,752 A 4/1991 Lin
5,040,391 A 8/1991 Lin
5,083,122 A 1/1992 Clark
5,473,236 A 12/1995 Frolov
5,544,507 A 8/1996 Lin
5,591,950 A 1/1997 Imedio-Ocaña
5,678,870 A * 10/1997 Pelletier ..... 292/244
5,694,798 A 12/1997 Nunez et al.
5,820,177 A * 10/1998 Moon ..... 292/335
5,941,581 A * 8/1999 Heithe ..... 292/332
5,987,945 A 11/1999 Aramburu
6,578,888 B1 * 6/2003 Fayngersh et al. ..... 292/332

* cited by examiner

AUTOMATIC DEADBOLT MECHANISM FOR A MORTISE LOCK

BACKGROUND OF THE INVENTION

This invention relates generally to mortise locks for use in doors, and more particularly to a mortise lock having a deadbolt, which automatically projects when the door is closed.

A mortise lock is designed to fit into a mortised recess formed in the edge of a door, which is opposite to the edge of the door that is hinged to the doorframe. The mortise lock generally includes a rectangular housing, or case, which encloses the lock components. One of the lock components includes a deadbolt which projects beyond the edge of the door and into an opening or strike plate in the doorframe to lock the door in a closed position. The deadbolt is moveable to a retracted deadbolt position inside the case to permit opening of the door by operation of a latch operator, such as a doorknob or lever handle.

Mortise locks are available that utilize deadbolts that project automatically upon closing of the door. Mortise locks with automatic deadbolts are often used in hotel room doors so that hotel guests do not need to independently and manually throw the deadbolts after closing their hotel room door.

Mortise lock assemblies with automatic deadbolts generally comprise a deadbolt biasing mechanism in the housing of the mortise lock assembly for continually biasing the deadbolt outwardly to the extended deadbolt position. A holding mechanism within the housing holds the deadbolt in a retracted deadbolt position against the force of the biasing mechanism when the door is opened. A trigger mechanism is provided for sensing the strike plate or doorframe when the door is closed. The deadbolt trigger mechanism functions to release the deadbolt holding mechanism so that the deadbolt projects to the extended deadbolt position into an opening in the strike plate or doorframe for locking the door. The deadbolt trigger mechanism is usually associated with an auxiliary latch which is pivotally mounted in the housing for movement from an extended auxiliary-latch position beyond the edge of the door to a retracted auxiliary-latch position in the housing when the auxiliary latch engages the strike plate or door frame. When the latch operator is used to retract the deadbolt for unlocking and opening the door, the deadbolt holding mechanism reengages the deadbolt for holding the deadbolt in the retracted deadbolt position.

Automatic deadbolt mortise lock assemblies often have problems with retaining the deadbolt in the retracted deadbolt position. Inadvertent release of the deadbolt causes the deadbolt to project to the extended deadbolt position before the door is closed. For example, installations where the gap between the front plate of the mortise lock housing through which the deadbolt extends and the strike plate in the door frame is sufficiently large and a room occupant rotates the latch operator sufficiently to allow the deadbolt to clear the opening in the strike plate and then releases the latch operator without a conventional holding mechanism being able to hold the deadbolt in the fully retracted deadbolt position because the auxiliary bolt has not cleared the strike plate, the deadbolt will fully extend outwardly when the door is opened beyond the strike plate. The extended deadbolt creates an undesired security problem as the deadbolt will interfere with the strike plate or doorframe and prevent the door from closing.

For the foregoing reasons, there is a need for a mortise lock that retains the automatic deadbolt in a retracted deadbolt position in the mortise lock assembly when the door is opened, automatically protects the deadbolt when the door is closed, and prevents the projection of the deadbolt when the auxiliary latch has not cleared the strike plate.

BRIEF SUMMARY OF THE INVENTION

One aspect of the present invention is an automatic deadbolt mechanism comprising a deadbolt, an auxiliary latch, and a trigger. The deadbolt is movable between a retracted deadbolt position and an extended deadbolt position. The deadbolt is biased in the extended deadbolt position. The auxiliary latch is movable between a retracted auxiliary-latch position and an extended auxiliary-latch position. The auxiliary latch is biased in the extended auxiliary-latch position. The trigger is biased in a first trigger position and movable between the first trigger position and a second trigger position. The trigger is operatively coupled to the deadbolt and to the auxiliary latch. The trigger is configured to be in the first trigger position when the auxiliary latch is in the extended auxiliary-latch position and in the second trigger position when the auxiliary latch is in the retracted auxiliary-latch position. The trigger also is configured to cause a first movement of the deadbolt from the retracted deadbolt position to the extended deadbolt position when the trigger moves from the first trigger position to the second trigger position, and to require movement of the auxiliary latch a predetermined distance from the retracted auxiliary-latch position toward the extended auxiliary-latch position before the trigger is able to cause a second movement of the deadbolt.

Another aspect of the present invention is a method for automatically moving a deadbolt of a mortise lock assembly having an auxiliary latch operatively coupled to the deadbolt. The method comprising the steps of: retracting the deadbolt from an extended deadbolt position to a retracted deadbolt position; releasably retaining the deadbolt in the retracted deadbolt position; and preventing the deadbolt from being released from the retracted deadbolt position until the auxiliary latch has moved a predetermined distance from a retracted auxiliary-latch position toward an extended auxiliary-latch position.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
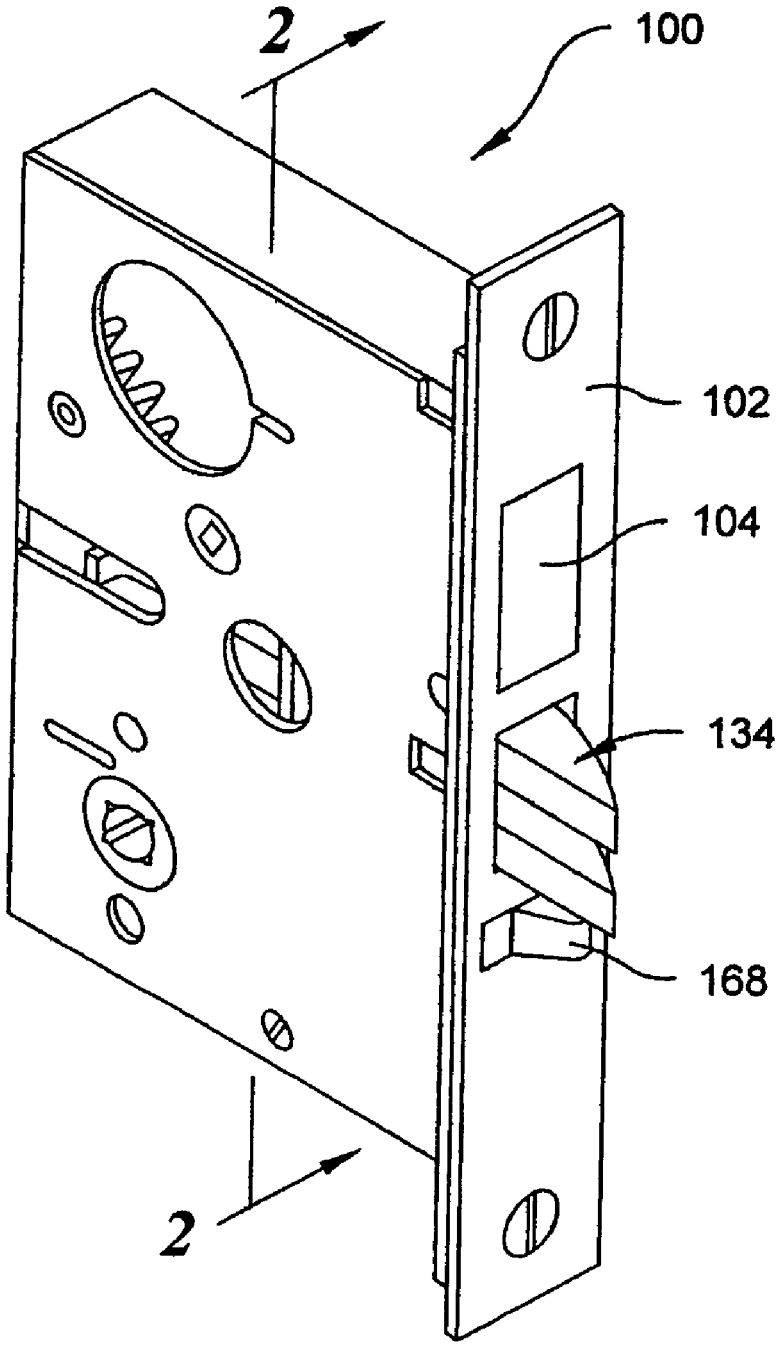
FIG. 1 is a perspective view of a preferred embodiment of a mortise lock assembly having therein an automatic deadbolt mechanism in accordance with the present invention.

Certain terminology is used in the following description for convenience only and is not limiting. The words "clockwise," and "counter clockwise" designate directions in the drawings to which reference is made. The words "inwardly" and "outwardly" refer to directions toward and away from, respectively, the geometric center of automatic deadbolt mechanism and designated parts thereof. The terminology includes the words above specifically mentioned, derivatives thereof and words of similar import. Additionally, as used in the claims and in the corresponding portion of the specification, the word "a" means "at least one".

Referring to FIGS. 1–7*d*, where like numerals indicate like elements throughout, there is shown a preferred embodiment of the automatic deadbolt mechanism, generally designated 100, and hereinafter referred to as the "deadbolt mechanism" 100, in accordance with the present invention. The deadbolt mechanism 100 preferably is for use in a mortise lock assembly, such as the mortise lock assembly which is the subject of U.S. Pat. No. 6,578,888 ("the '888 patent"), entitled "Mortise Lock With Automatic Deadbolt", issued Jun. 17, 2003 and assigned to the assignee of the present application. The '888 patent is incorporated herein by reference.

Referring to FIG. 1, the deadbolt mechanism 100 preferably is mounted in a generally rectangular shaped housing 102 adapted to be received in a mortise in the free, or unhinged edge of a door (not shown).

Referring to FIGS. 2–3 and 4*a*–4*c*, the deadbolt mechanism 100 has a deadbolt 104 with a generally rectangular head portion 106 and a tail portion 108 with a slot 110. A lug 112 extends from the tail portion 108. The deadbolt 104 is slideably mounted in the housing 102 and is movable between a retracted deadbolt position shown in FIG. 2 and FIG. 4*a* and an extended deadbolt position shown in FIG. 4*c*. The deadbolt 104 is biased in the extended deadbolt position as discussed below.

A deadbolt lever 114 is operably coupled to the deadbolt 104. The deadbolt lever 114 is biased in a first deadbolt-lever position shown in FIG. 4*a* and is pivotable between the first deadbolt-lever position and a second deadbolt-lever position shown in FIG. 4*c*. The deadbolt lever 114 is configured to cause the deadbolt 104 to be in the extended deadbolt position when the deadbolt lever 104 is in the first deadbolt-lever position and to cause the deadbolt 104 to be in the retracted deadbolt position when the deadbolt lever is in the second deadbolt-lever position. Preferably, the deadbolt lever 114 has a first leg 114*a* and a generally hook-shaped second leg 114*b*, each of which extends generally radially outwardly from a central, generally cylindrical hub 114*c* (FIG. 3) pivotably connected to the housing 102. The first leg 114*a* is positioned in the slot 110 of the deadbolt 104. The deadbolt lever 114 is biased in the first deadbolt-lever position by a first elastic member, such as a coil spring 116, having one end connected to the hook-shaped second leg 114*b* of the deadbolt lever 114 and the other end connected to a sidewall of the housing 102.

Figure 2:
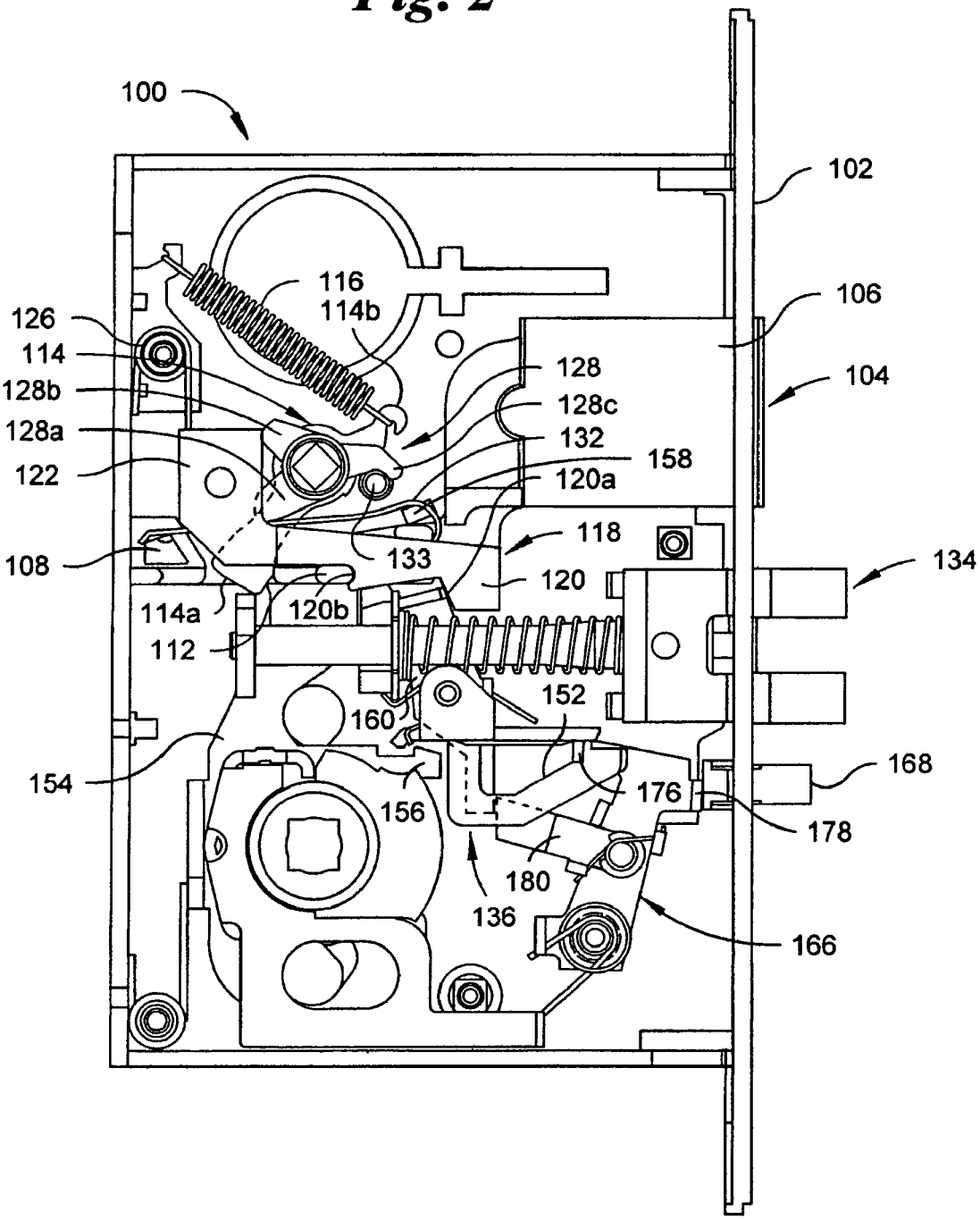
FIG. 2 is an enlarged vertical cross sectional view of a mortise lock assembly of FIG. 1 taken along the line 2—2 of FIG. 1.
Figure 3:
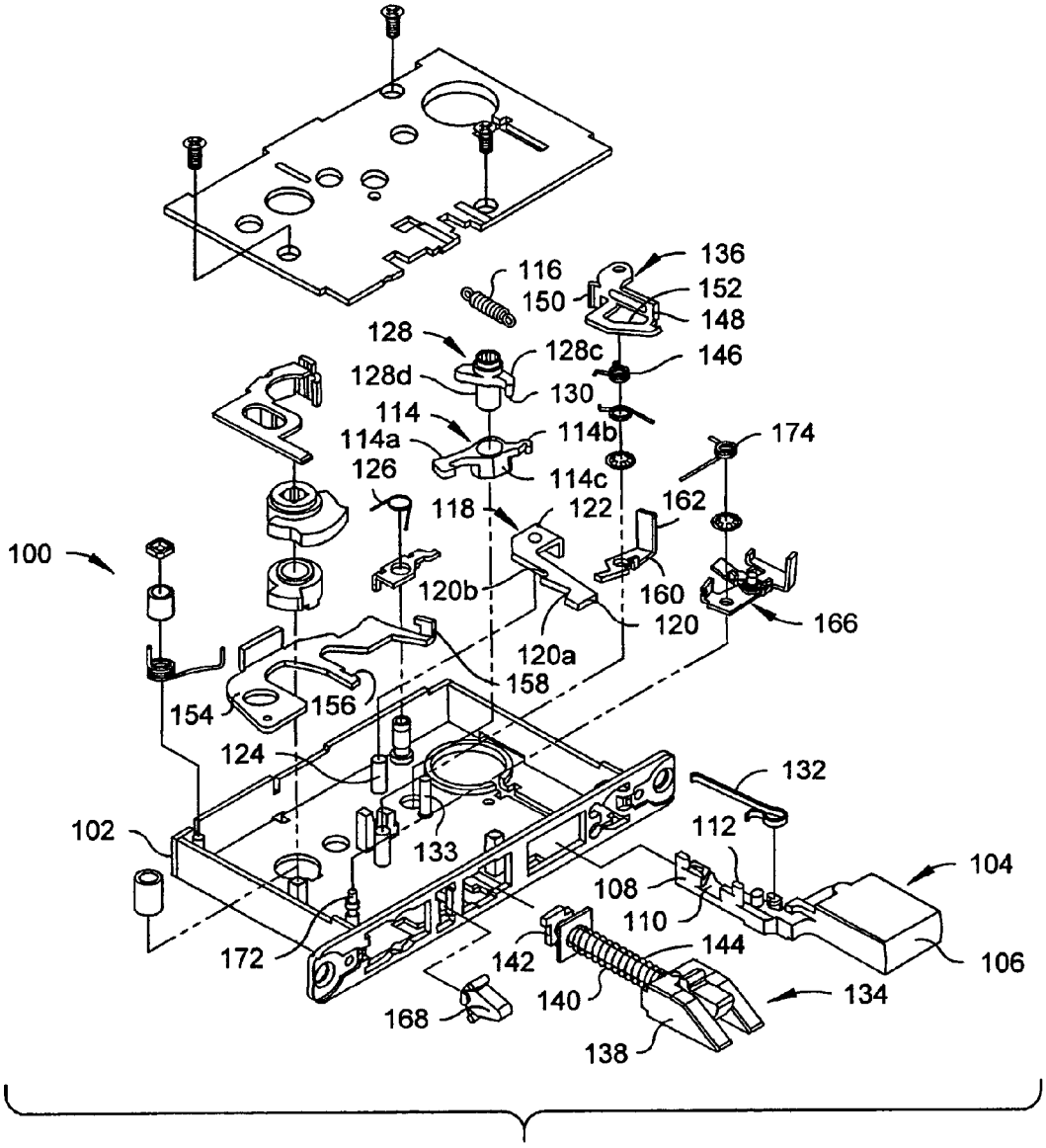
FIG. 3 is an exploded perspective view of the mortise lock assembly in FIG. 2.
Figure 4A:
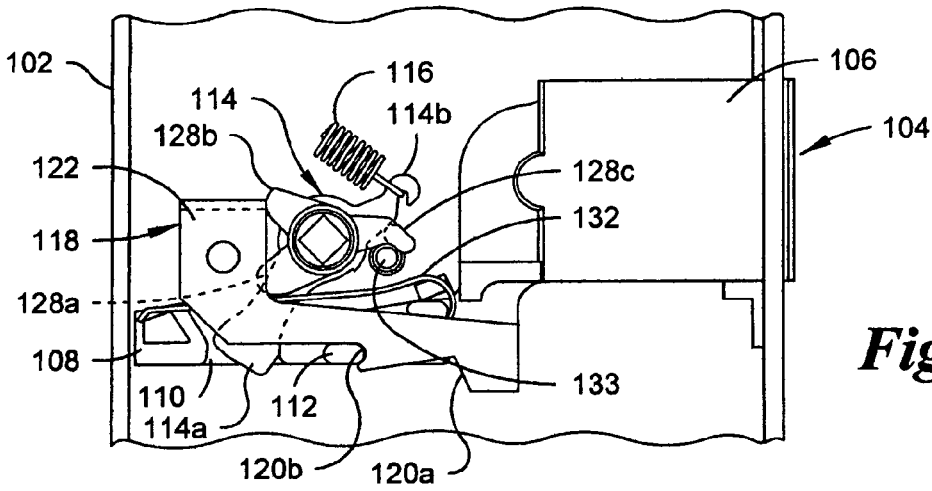
FIG. 4*a* is a vertical cross sectional view of a portion of the mortise lock assembly in FIG. 2 showing the deadbolt holding lever in the first deadbolt holding-lever position.
Figure 4B:
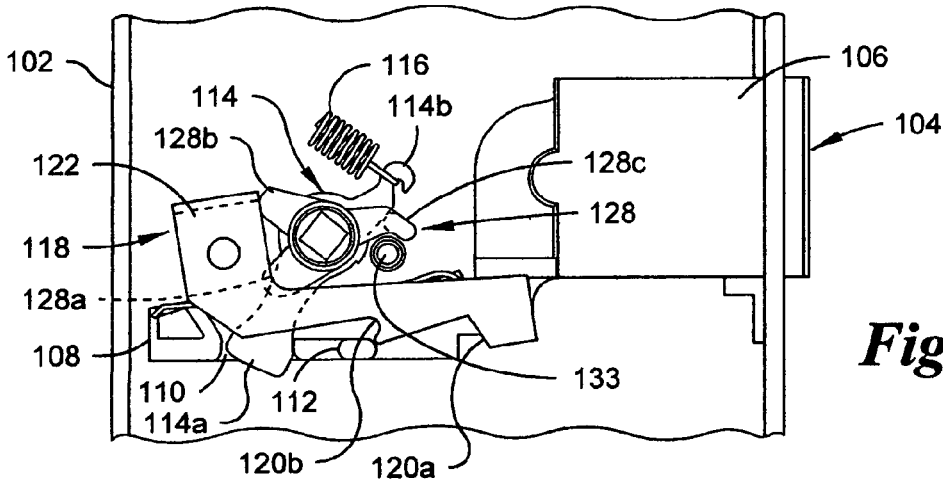
FIG. 4*b* is a vertical cross sectional view of a portion of the mortise lock assembly in FIG. 2 showing the deadbolt holding lever between the first and second deadbolt holding-lever positions.
Figure 4C:
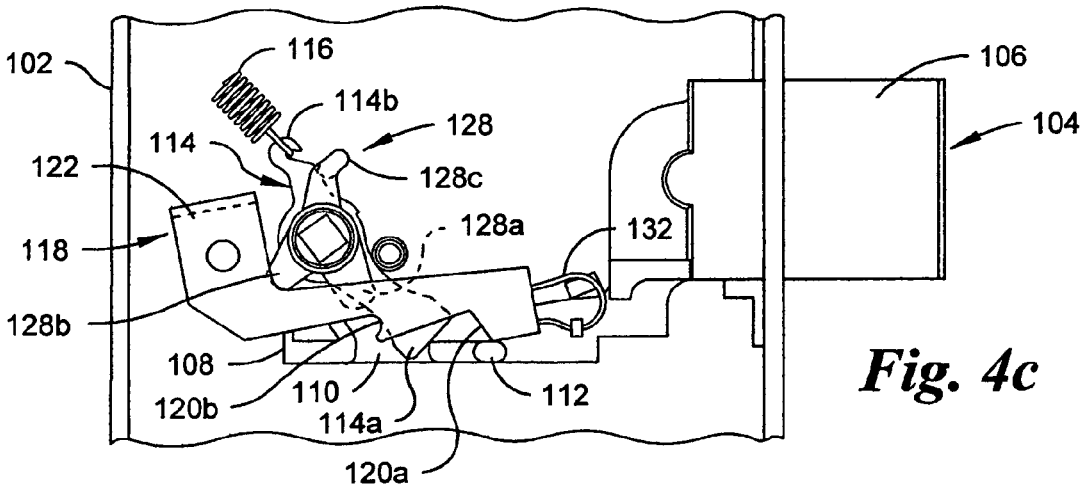
FIG. 4*c* is a vertical cross sectional view of a portion of the mortise lock assembly in FIG. 2 showing the deadbolt holding lever in the second deadbolt holding-lever position.
Figure 5:
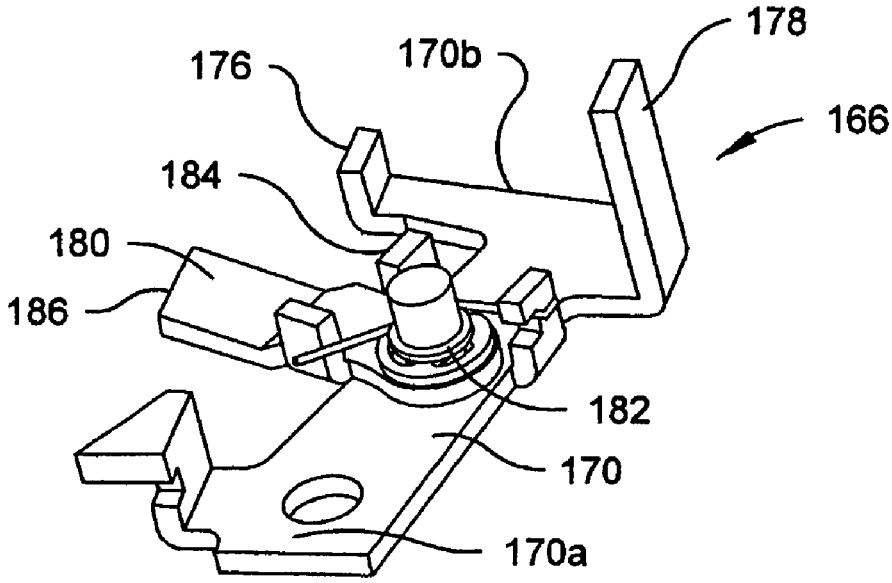
FIG. 5 is an enlarged perspective view of the trigger in FIG. 2.
Figure 6:
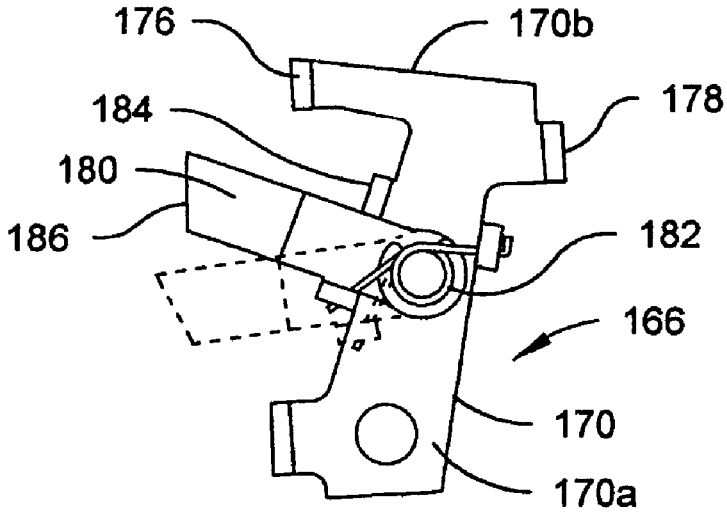
FIG. 6 is an enlarged side elevation view of the trigger in FIG. 2.

Referring to FIGS. 2–4*c*, the deadbolt mechanism 100 has a deadbolt holding lever 118 biased in a first deadbolt holding-lever position as shown in FIGS. 2 and 4*a* and is pivotable between the first deadbolt holding-lever position and a second deadbolt holding-lever position shown in FIG. 4*c*. The deadbolt holding lever 118 is configured to releasably retain the deadbolt 104 in the retracted deadbolt position when the deadbolt holding lever 118 is in the first deadbolt holding-lever position. The deadbolt holding lever 118 preferably is a generally L-shaped member having an elongated first leg 120 and second leg 122 shorter than the first leg 120. The first leg 120 is pivotably connected to the housing 102 by a pivot pin 124. The first leg 120 has an edge with a cam surface 120*a* and a recess 120*b*. The cam surface 120*a* is proximal to an end of the first leg 120. The recess 120*b* is spaced from the end of the first leg 120. The deadbolt holding lever 118 is biased in the first deadbolt holding-lever position by a second elastic member, such as a torsion spring 126 having one end connected to the deadbolt holding lever 118 and the other end connected to the housing 102.

A turn lever 128 is operably coupled to the deadbolt holding lever 118 and the deadbolt lever 114. The turn lever 128 is pivotable between a first turn-lever position shown in FIG. 4*a* and a second turn-lever position shown in FIG. 4*b* in which a portion of the turn-lever engages the deadbolt holding lever 118 as discussed below. The turn lever 128 is further pivotable between the second turn-level position and a third turn-lever position shown in FIG. 4*c*. The turn lever 128 is configured to cause the deadbolt holding lever 118 to pivot from the first deadbolt-holding-lever position to the second deadbolt-holding-lever position when the turn lever pivots from the first turn-lever position to the second turn-lever position. The turn lever is further configured to cause the deadbolt lever 114 to move the deadbolt 104 from the retracted deadbolt position to the extended deadbolt position when the turn lever 128 pivots from the second turn-lever position to the third turn-lever position. Preferably, a knob (not shown) is attached to the turn lever 128 to facilitate rotation of the turn lever 128.

The turn lever 128 has a first lobe 128*a*, a second lobe 128*b*, and a third lobe 128*c*. The third lobe 128*c* has a boss 130 (FIG. 3) extending therefrom. Each of the lobes 128*a*, 128*b*, 128*c* extends generally radially outwardly from a central, generally cylindrical hub 128*d* (FIG. 3) journaled with the deadbolt-lever hub 114*c* and pivotably connected to the housing 102. When the turn lever 128 is in the first turn-lever position, the first lobe 128*a* engages a leaf spring 132 connected to the tail 108 of the deadbolt 104, the second lobe 128*b* is adjacent the second leg 122 of the deadbolt holding lever 118, the third lobe 128*c* is biased against a turn lever stop 133 connected to the housing 102 and the boss 130 on the third lobe is adjacent the second leg 114*b* of the deadbolt lever 114.

The deadbolt mechanism 100 preferably, but not necessarily, has a latchbolt 134 and a deadlocking lever 136 that are substantially the same as the latchbolt and deadlocking lever disclosed in the '888 patent above. The latchbolt 134 is slideably mounted in the housing 102 and is movable between an extended latchbolt position shown in FIG. 2 and a retracted latchbolt position (not shown). The latchbolt 134 has a bolt head 138 and a latch tail 140 with a tailplate 142 and is biased in the extended position by an elastic member, such as a compression spring 144.

The deadlocking lever 136 is pivotably mounted to the housing 102 and is pivotable between a first deadlocking-lever position shown in FIG. 2 and a second deadlocking-lever position (not shown) wherein the deadlocking lever 136 does not interfere with the movement of the latchbolt 134. The deadlocking lever 136 is biased in the first deadlocking-lever position by an elastic member such as a torsion spring 146. The deadlocking lever 136 is configured to block movement of the latchbolt 134 from the extended latchbolt position to the retracted latchbolt position when the deadlocking lever 136 is in the first deadlocking-lever position. The deadlocking lever 136 has a first end forming a blocking surface 148, a second end defining a lip 150 and an opening with an inclined cam surface 152.

The deadbolt mechanism 100 preferably, but not necessarily, has a hub lever 154, substantially the same as the hub lever disclosed in the '888 patent. The hub lever 154 is operably coupled to the deadbolt lever 114, the latchbolt 134, and the deadlocking lever 136. The hub lever 154 is pivotable between a first hub-lever position shown in FIG. 2 and a second hub-lever position (not shown) and is biased in the first hub-lever position. The hub lever 154 is configured to cause the deadbolt lever 114 to pivot from the second deadbolt-lever position to the first deadbolt-lever position, the deadlocking lever 136 to pivot from the first deadlocking-lever position to the second deadlocking-lever position, and the latchbolt 134 to move from the extended latchbolt position to the retracted latchbolt position when the hub lever 154 pivots from the first hub-lever position to the second hub-lever position. Preferably, the hub lever 154 has a first arm 156 that is engageable with the lip 150 of the deadlocking lever 136 and a second arm 158 that is engageable with the deadbolt lever 114. Detail regarding the structure and operation of the hub lever disclosed in the '888 patent is also applicable to the hub lever 154 and for brevity is not further described here.

The deadbolt mechanism 100 preferably, but not necessarily, has a release lever 160, that is operably coupled to the deadbolt holding lever 118. The release lever 160 is biased in a first release-lever position shown in FIGS. 2 and 7*a* and is pivotable between the first release-lever position and a second release-lever position oriented slightly more clockwise than the position of the release lever in FIG. 7*b*, such that the release lever 160 clears the cam surface 120*a* of the deadbolt holding leaper 118 and the trigger lever 180 discussed below. The release lever 160 is configured to cause the deadbolt holding lever 118 to pivot from the first deadbolt holding-lever position toward the second deadbolt holding-lever position when the release lever 160 pivots from the first release-lever position toward the second release-lever position. Preferably, the release lever 160 is pivotable connected to the housing 102 and has a deadbolt holding-lever engaging arm 162 for slideable engagement with the cam surface 120*a* of the first leg 120 of the deadbolt holding lever 118 and a trigger engaging arm 164 for engaging a trigger 166 discussed below.

Figure 7A:
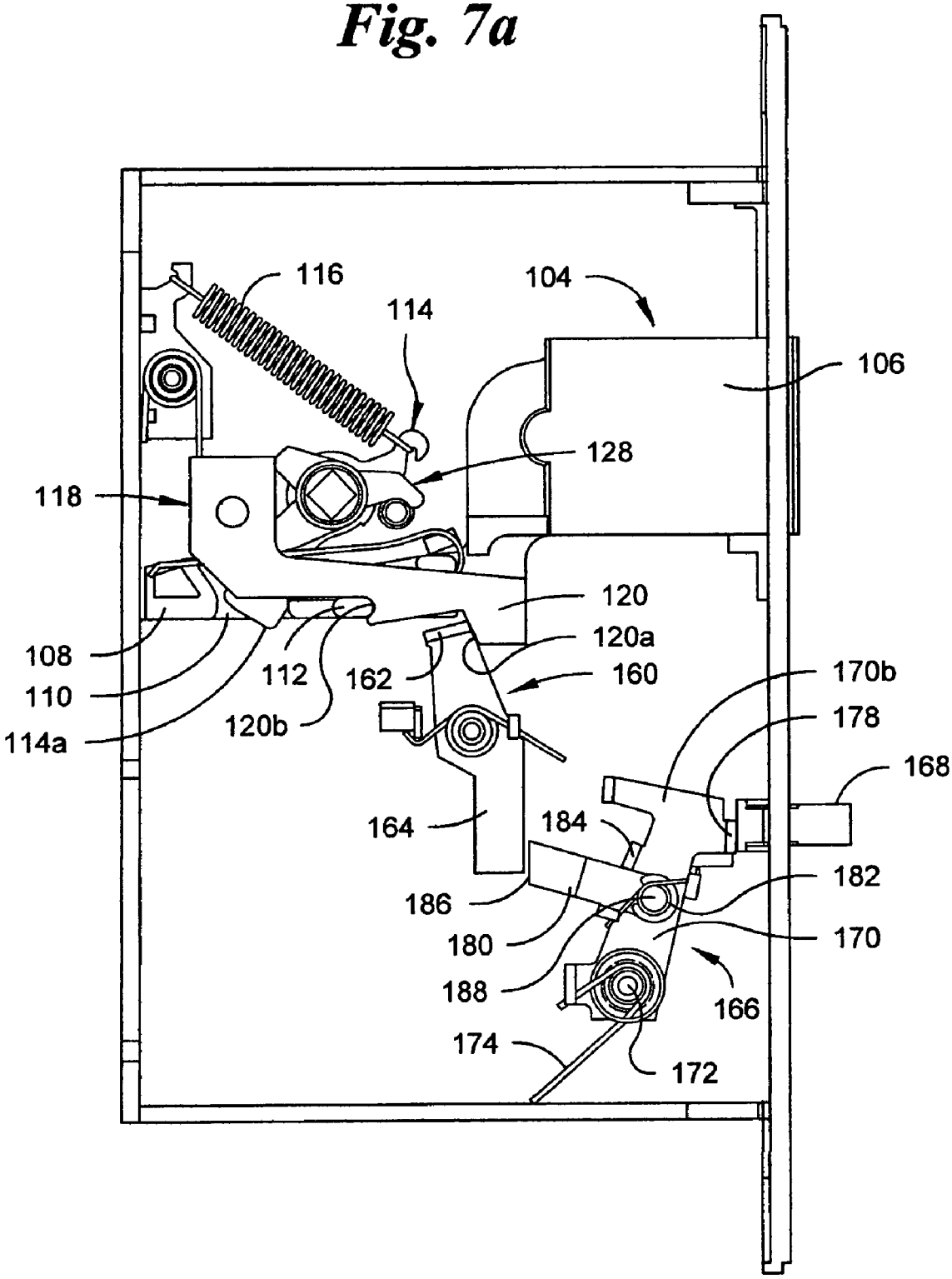
FIG. 7*a* is a side elevation view of a portion of the mortise lock assembly in FIG. 2 showing the auxiliary bolt in the extended auxiliary-bolt position, the trigger in the first trigger position, the release lever in the first release-lever position and the deadbolt in the retracted deadbolt position.
Figure 7B:
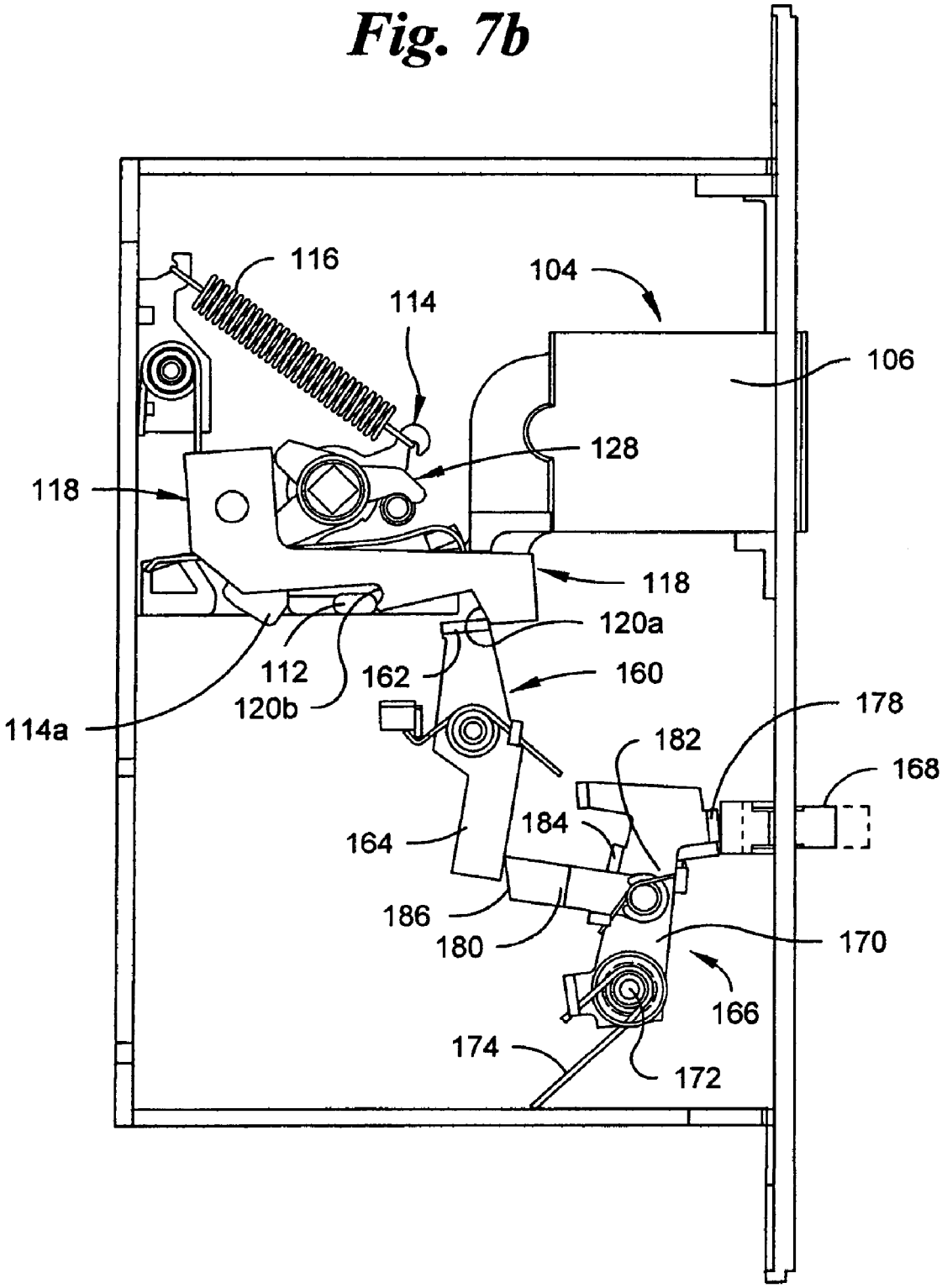
FIG. 7*b* is a side elevation view of a portion of the mortise lock assembly in FIG. 2 showing the auxiliary bolt in a partially retracted position, the trigger pivoted from the first trigger position toward the second trigger position, the release lever pivoted from the first release lever position toward the second release lever position, and the deadbolt retained in the retracted deadbolt position.
Figure 7C:
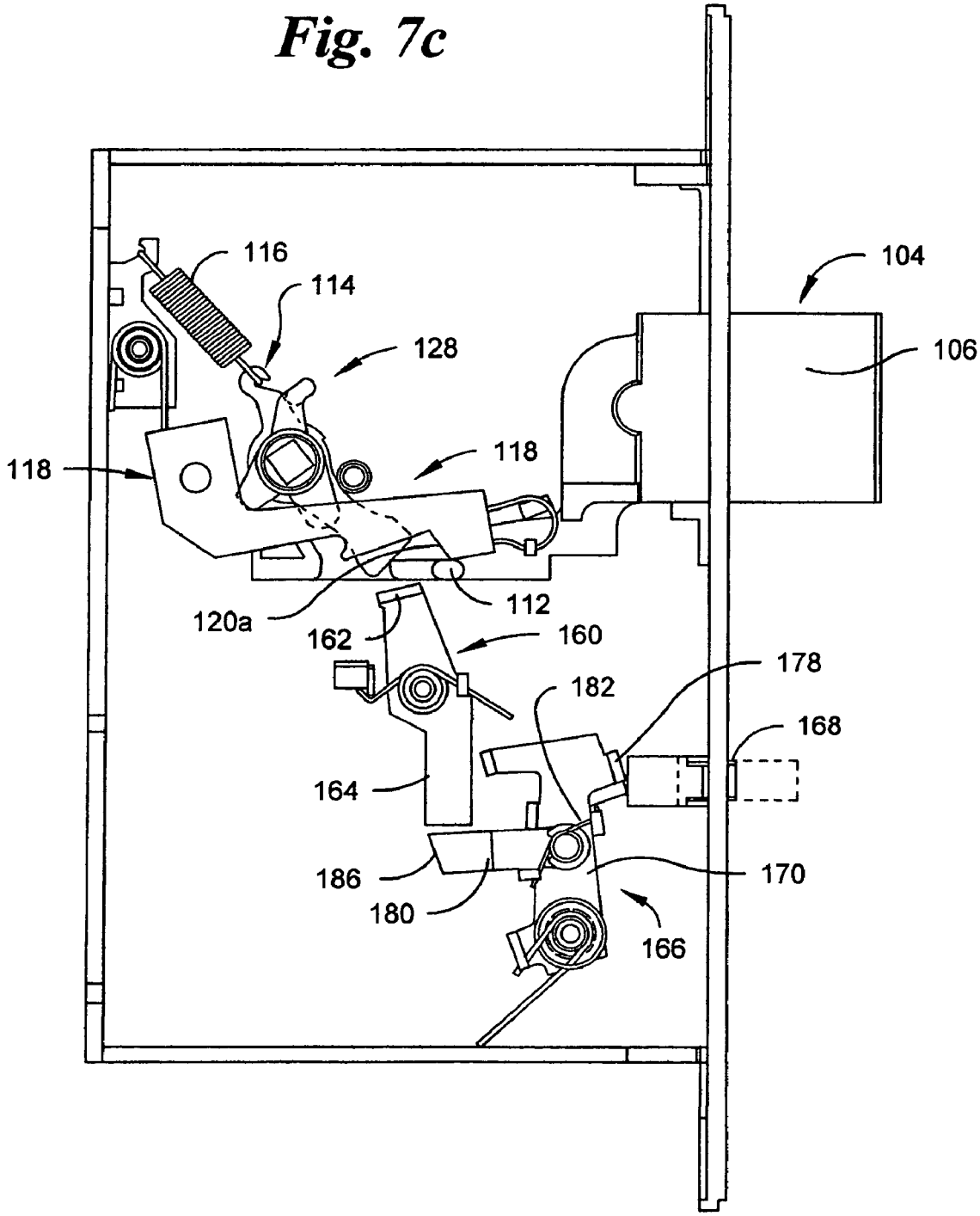
FIG. 7*c* is a side elevation view of a portion of the mortise lock assembly in FIG. 2 showing the auxiliary bolt in the retracted auxiliary-bolt position, the trigger in the second trigger position, the release lever in the first release-lever position, and the deadbolt in the extended deadbolt position.

The deadbolt mechanism 100 has an auxiliary latch 168 that is movable between a retracted auxiliary-latch position as shown in FIG. 7*c* and an extended auxiliary-latch position as shown in FIG. 7*a*. The auxiliary latch 168 is biased in the extended auxiliary-latch position and preferably is pivotably mounted to the housing 102.

The deadbolt mechanism 100 has a trigger 166 that is operatively coupled to the deadbolt 104 and the auxiliary latch 168. Preferably, the trigger 166 is pivotably connected to the housing 102. The trigger 166 is biased in a first trigger position shown in FIG. 7*a* and movable between the first trigger position and a second trigger position shown in FIG. 7*c*. The trigger 166 is configured to be in the first trigger position when the auxiliary latch 168 is in the extended auxiliary-latch position and in the second trigger position when the auxiliary latch 168 is in the retracted auxiliary-latch position. The trigger 166 is further configured to cause a first movement of the deadbolt 104 from the retracted deadbolt position to the extended deadbolt position when the trigger 166 moves from the first trigger position to the second trigger position. Still further, the trigger 166 is configured to require movement of the auxiliary latch 168 a predetermined distance from the retracted auxiliary-latch position toward the extended auxiliary-latch position before the trigger 166 is able to cause a second movement of the deadbolt 104. The predetermined distance is greater than a gap, if any, that may exist between the edge of the door from which the auxiliary latch 168 is projectable and the strike plate in the doorframe and less than the possible length of travel of the auxiliary latch 168 from the retracted auxiliary-latch position to the extended auxiliary-latch position.

Preferably, the trigger 166 also is operatively coupled to the release lever 160 and is configured to cause a first pivot of the release lever 160 from the first release-lever position to the second release-lever position when the trigger 166 pivots from the first trigger position to the second trigger position. The trigger 166 is also configured to require movement of the auxiliary latch 168 the predetermined distance from the retracted auxiliary-latch position toward the extended auxiliary-latch position before the trigger 166 is able to cause a second pivot of the release lever 160.

The trigger 166 may also be operatively coupled to the deadlocking lever 136 and to retain the deadlocking lever 136 in the second deadlocking-lever position when the trigger 166 is in the first trigger position. Detail regarding the cooperation between the trigger 166 and the deadlocking lever 136 is disclosed in the '888 patent and for brevity is not further discussed here.

Referring to FIGS. 5–7*d*, the trigger 166 has an auxiliary-latch lever 170 having a first end 170*a* and a second end 170*b*. The first end 170*a* is pivotably mounted to the housing 102 by a trigger pivot pin 172. The auxiliary-latch lever 170 is pivotable between a triggering (or first) auxiliary-latch position (FIG. 7*a*) and a triggered (or second) auxiliary-latch position (FIG. 7*c*). The triggering auxiliary-latch position and the triggered auxiliary-latch position correspond to the first and second trigger positions, respectively. The auxiliary-latch lever 170 is biased in the triggering position by an elastic member such as a trigger torsion spring 174. The second end 170*b* of the auxiliary-latch lever 170 has a camming arm 176 extending laterally from an inwardly facing side thereof into the opening in the deadlocking lever 136 and an auxiliary-latch engaging arm 178 extending laterally from an outwardly facing side thereof. The camming arm 176 slideably engages the inclined cam surface 152 forming a portion of the bounding surface of the opening. The auxiliary-latch engaging arm 178 engages an inwardly facing surface of the auxiliary latch 168.

A trigger lever 180 is pivotably connected to the auxiliary-latch lever 170 by a trigger-lever pivot 188 generally positioned at the geometric center of the auxiliary-latch lever 170. The trigger lever 180 is biased in a triggering (or first) position by a torsion spring 182 and is pivotable between the triggering position and a second position as shown in phantom in FIG. 6. When the trigger lever 180 is in the triggering position, the trigger lever 180 abuts a stop 184 extending from the auxiliary-latch lever 170. The trigger lever 180 has a release-lever engaging end 186 that is slideably engageable with the trigger-lever engaging arm 164 of the release lever 160.

Figure 8:
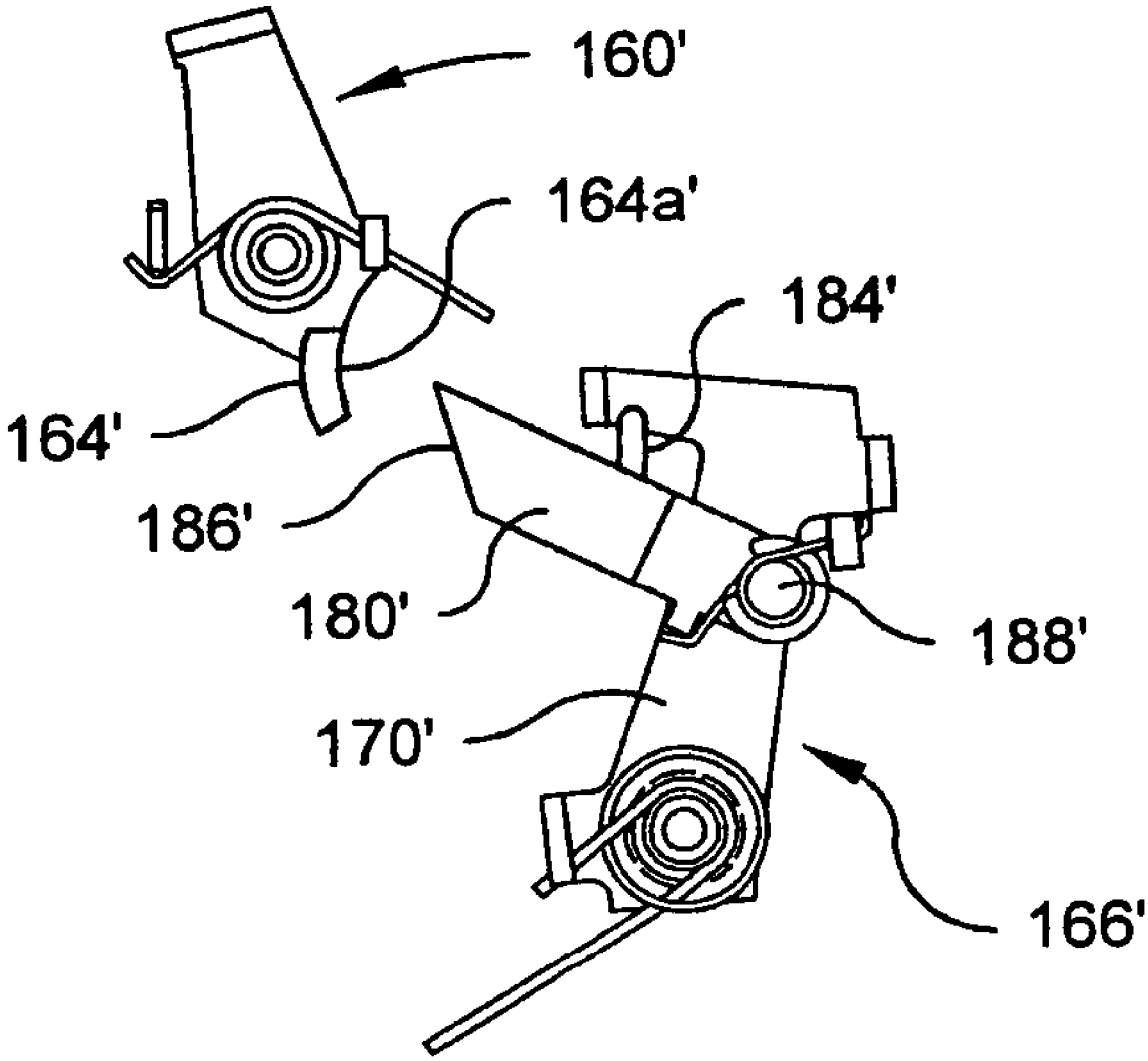
FIG. 8 is an enlarged side elevation view of another embodiment of the release lever and trigger in accordance with the present invention.

Referring to FIG. 8, there is shown another preferred embodiment of a release lever, hereafter referred to as the release lever 160', and a trigger, hereafter referred to as the trigger 166', in accordance with the present invention. As shown in FIG. 8, the release lever 160' and the trigger 166 have substantially the same orientation as the release lever 160 and the trigger 166 shown in FIG. 7*a*. The release lever 160' has a trigger-lever engaging arm 164' with a generally concave portion 164*a'* for engaging a release-lever engaging end 186' of the trigger lever 180'. The trigger lever 180' is pivotably connected to the auxiliary-latch lever 170' by a trigger-lever pivot 188' that is offset from the geometric center of the auxiliary-latch lever 170'. Similar to the trigger lever 180, the trigger lever 180' abuts a stop 184' extending from the auxiliary latch lever 170' when the trigger lever 180' is in the triggering position. The release lever 160' operatively engages the trigger 166' in a manner similar to the operative coupling of the release lever 160 to the trigger 166 and for brevity is not further discussed herein.

Figure 9:
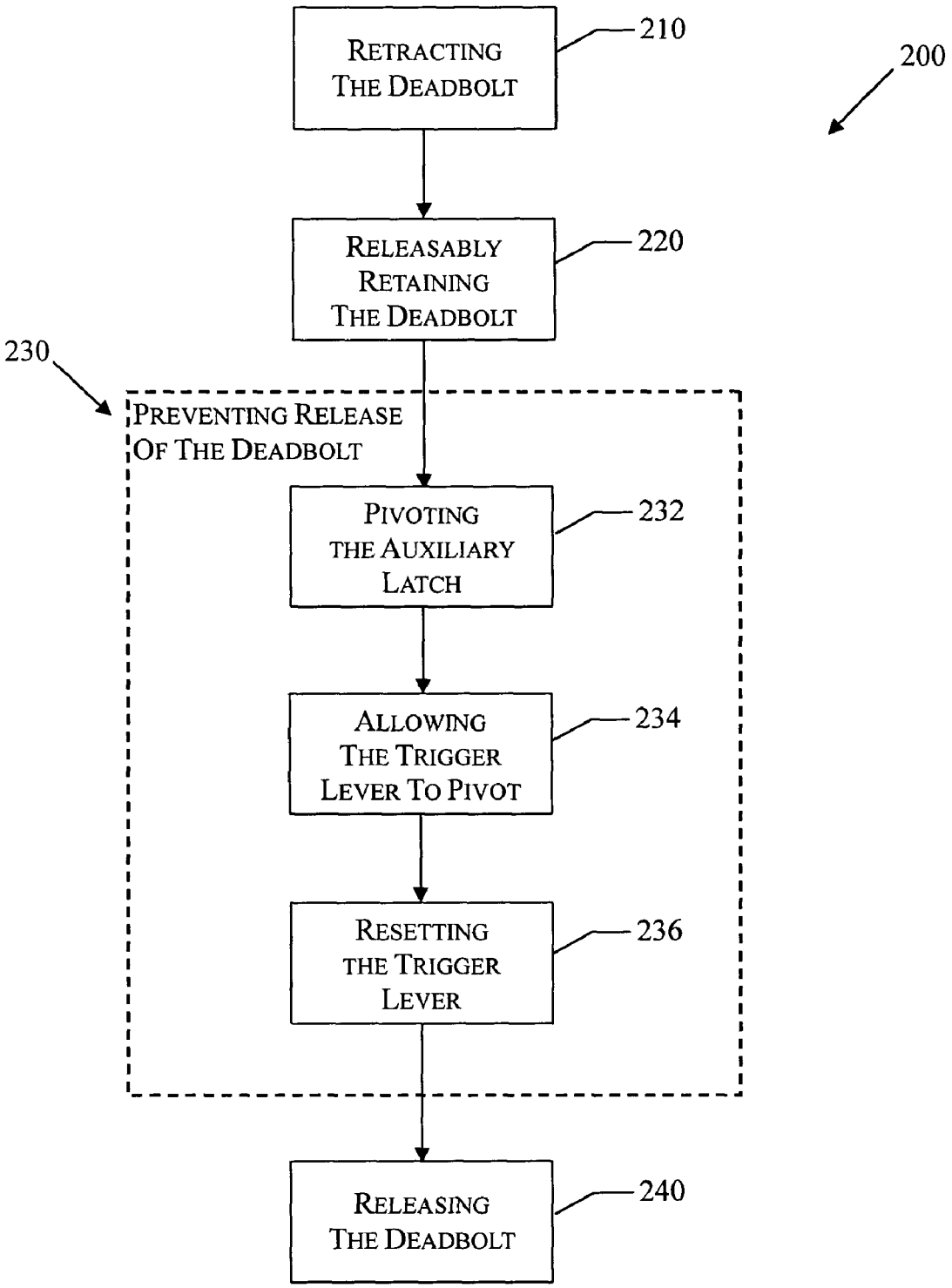
FIG. 9 is a diagram of a preferred method for automatically moving a deadbolt in accordance with the present invention.

Referring to FIG. 9, there is shown a preferred method, generally designated 200, and hereinafter referred to as the method 200 for automatically moving a deadbolt of a mortise lock assembly having an auxiliary latch operatively coupled to the deadbolt in accordance with the present invention. The method 200 is best understood with reference to the several configurations of the components of the automatic mechanism 100 discussed above and shown in FIGS. 7*a*–7*d*. Accordingly, the manner in which the automatic mechanism 100 is used and the method 200 are disclosed below in concert.

Figure 7D:
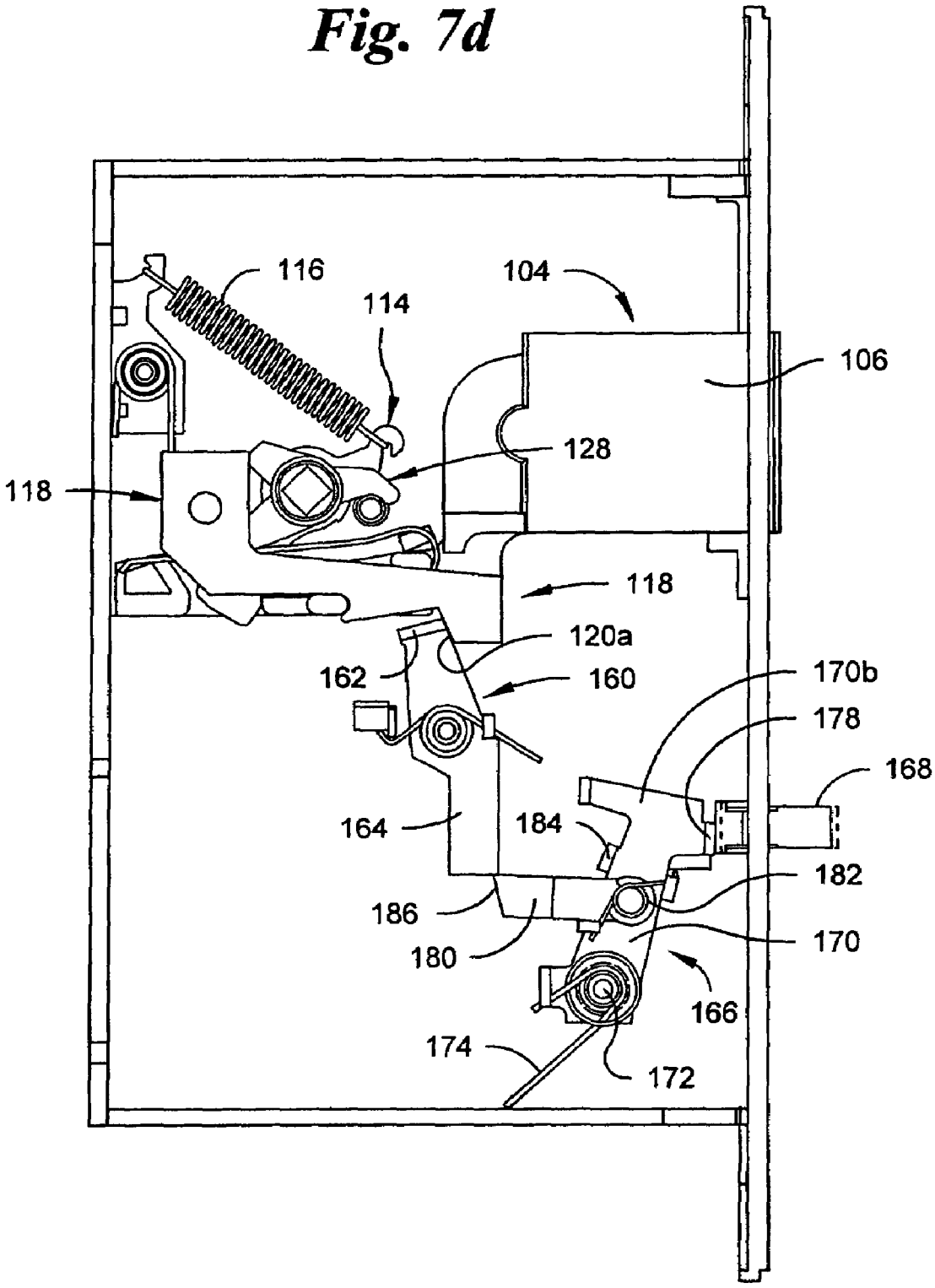
FIG. 7*d* is a side elevation view of a portion of the mortise lock assembly in FIG. 2 showing the auxiliary-latch lever in a partially extended position, the trigger lever pivoted from the second trigger position toward the first trigger position, the release lever in the first release-lever position, and the deadbolt in the retracted deadbolt position.

Referring to FIGS. 7*a*–7*c*, the configuration and orientation of the components of the deadbolt mechanism 100 are shown as a door (not shown) in which the deadbolt mechanism 100 is mounted is moved from an open position (FIG. 7*a*) in which the edge of the door beyond which the deadbolt 104 and auxiliary latch 168 are extendable has cleared in its entirety a strike plate (not shown) of a doorframe (not shown) to a closed position in which the edge of the door is adjacent the strike plate, the auxiliary latch 168 is in the retracted auxiliary-latch position and the deadbolt 104 is in the extended deadlock position. FIG. 7*d* shows the configuration and orientation of the components of the deadbolt mechanism 100 when a room occupant has turned a latch operator (not shown) such as an inside door knob (not shown) operatively coupled to the hub lever 154 to retracted the deadbolt 104 to open a closed door and has released the door knob before the auxiliary latch 169 clears in its entirety the strike plate.

More specifically, referring to FIG. 7*a*, the deadbolt 104, the deadbolt holding lever 118, the release lever 160, the trigger 166, and the auxiliary latch 168 are shown in a configuration corresponding to the configuration that the components of the deadbolt mechanism 100 have when the door is in an open position. The deadbolt 104 is in the retracted deadbolt position. The deadbolt holding lever 118 is in the first deadbolt holding-lever position preventing extension of the deadbolt 104 by retaining the lug 112 on the tail portion 108 of the deadbolt 104 in the recess 120*b* of the first leg 120 of the deadbolt holding lever 118. The auxiliary latch 168 is in the extended auxiliary-latch position. The trigger 166 is in the first trigger position, as is the auxiliary-latch lever 170. The release lever 160 is in the first release-lever position.

The auxiliary-latch engaging arm 178 extending from the second end 170*b* of the auxiliary-latch lever 170 is engaged with an inwardly facing surface of the auxiliary latch 168. The trigger lever 180 pivotably attached to the auxiliary-latch lever 170 is in the triggering (or first) trigger-lever position abutting the stop 184. The release-lever engaging end 186 of the trigger lever 180 is slideably engageable with the trigger engaging arm 164 of the release lever 160. The deadbolt holding-lever engaging arm 162 of the release lever 160 is engaged with the cam surface 120*a* of the first leg 120 of the deadbolt holding lever 118.

Referring to FIGS. 7*b* and 7*c*, the configurations shown therein correspond to the components of the deadbolt mechanism 100 as the door is being closed and the auxiliary latch 168 is partially retracted (FIG. 7*b*) by the strike plate and when the door is closed and the auxiliary-latch 168 is fully retracted (FIG. 7*c*) by the strike plate. As the auxiliary latch 168 is partially retracted, the auxiliary-latch lever 170 pivots counter-clockwise. The trigger lever 180 abutted against the stop 184 remains fixed relative to the auxiliary-latch lever 170 and pivots therewith causing the release-lever engaging end 186 of the trigger lever 180 to engage and pivot the release lever 160 in a clockwise direction. The pivoting of the release lever 160 causes the deadbolt holding-lever engaging arm 162 to pivot the deadbolt holding lever 118 in a counter-clockwise direction to the second deadbolt-holding-lever position, releasing the lug 112 from the recess 120*b* and enabling the deadbolt 104 biased by the coil spring 116 to move to the extended deadbolt position (and project into an opening in the strike plate in the doorframe, locking the door). When the auxiliary latch 168 has reached the retracted auxiliary-latch position (FIG. 7*c*), the auxiliary-latch lever 170 has pivoted to the second auxiliary-latch position, the trigger lever 180 has moved past the trigger engaging arm 164 of the release lever 160 and the release lever 160, under the force of a release-lever torsion spring, has returned to the first release-lever position. This allows the deadbolt holding lever 118, biased to pivot from the second deadbolt-holding-lever position to the first deadbolt-holding-lever position, to retain the deadbolt 104 in the retracted deadbolt position when the deadbolt 104 is retracted to open the door.

Referring to FIG. 7*d*, the configuration shown therein corresponds to the configuration that the components of the deadbolt mechanism 100 have when a room occupant has turned a latch operator (not shown) such as an inside door knob operatively coupled to the hub lever 154 (FIGS. 2–3) to fully retracted the deadbolt 104 to open a closed door and has released the door knob before the auxiliary latch 168 clears in its entirety the strike plate. Under these circumstances, the deadbolt 104 is retained in the retracted deadbolt position by the deadbolt holding lever 118 and the release lever 160 is in the first release-lever position. The auxiliary latch 168 has partially extended allowing the trigger 166 to pivot in a clockwise direction from the second trigger position toward the first trigger position in response to the force applied by the trigger-lever torsion spring 182. The trigger lever 180 has pivoted in a counter clockwise direction from the first trigger-lever position toward the second trigger-lever position as the release lever engaging end 186 of the trigger lever 180 will not clear the trigger engaging arm 164 until the auxiliary latch 168 extends further, and preferably fully extends to the first auxiliary-latch position as shown in FIG. 7*a*.

The method 200 of the present invention for automatically moving a deadbolt of a mortise lock assembly having an auxiliary latch operatively coupled to the deadbolt comprises the steps subsequently disclosed with reference to the deadbolt mechanism 100 discussed above.

The retracting the deadbolt step 210 retracts the deadbolt 104 from an extended deadbolt position (FIG. 7*c*) to a retracted deadbolt position (FIG. 7*d*). As discussed above, retracting the deadbolt 104 typically occurs with the door in a closed position. A room occupant desiring to leave or enter a room turns either an outside or an inside door knob connected to the hub lever 154 (FIG. 3). Turning the door knob pivots the hub lever 154 causing the deadbolt lever 114 to pivot from the second deadbolt-lever position to the first deadbolt-lever position. As the hub lever 154 pivots, the second arm 158 of the hub lever 154 engages and pivots the deadbolt lever 114, thereby retracting the deadbolt 104.

The releasably retaining the deadbolt step 220 releasably retains the deadbolt 104 in the retracted deadbolt position. As discussed above, retaining the deadbolt 104 in the retracted deadbolt position is preferably achieved by pivoting the deadbolt holding lever 118 from the second deadbolt holding-lever position in which the deadbolt 104 is not engaged (FIG. 7*c*) to the first deadbolt holding-lever position (FIG. 7*a*), thereby engaging the deadbolt 104 by releasably retaining the lug 112 on the tail portion 108 of the deadbolt 104 in the recess 120*b* of the first leg 118 of the deadbolt holding lever 118.

The preventing release of the deadbolt step 230 prevents the deadbolt 104 from being released from the retracted deadbolt position until the auxiliary latch 168 has moved a predetermined distance from the retracted auxiliary-latch position (FIG. 7*c*) toward the extended auxiliary-latch position (FIG. 7*a*). The predetermined distance is preferably greater than a gap, if any, that may exist between the edge of the door from which the auxiliary latch 168 is projectable and the strike plate in the doorframe and less than or equal to the possible length of travel of the auxiliary latch 168 from the retracted auxiliary-latch position to the extended auxiliary-latch position.

Preferably, the mortise lock assembly to which the method 200 is applied has an auxiliary-latch lever 170 operatively coupled to the auxiliary latch 168 and a trigger lever 180 pivotably attached to the auxiliary-latch lever 170 and operatively coupled to the deadbolt 104. For a mortise lock assembly with the aforementioned components, the preventing release of the deadbolt step 230 preferably further comprises a pivoting step 232, an allowing step 234 and a resetting step 236.

The pivoting step 232 pivots the auxiliary-latch lever 170 from a triggered (or second) auxiliary-latch lever position (FIG. 7*c*) toward a triggering (or first) auxiliary-latch lever position (FIG. 7*a*) as the auxiliary latch 168 moves the predetermined distance.

The allowing step 234 allows the trigger lever 180 to pivot relative to the auxiliary-latch lever 170 as the auxiliary-latch lever 170 pivots from the triggered (or second) auxiliary-latch lever position toward the triggering (or first) auxiliary-latch lever position. Allowing the trigger lever 180 to pivot in a counter clockwise direction while the auxiliary-latch lever 170 is pivoting in a clockwise direction in the pivoting step 232 allows the release lever 160 to remain in the first release-lever position, thereby preventing the release-lever 160 from causing the deadbolt holding lever 118 to pivot and release the deadbolt 104. Referring to FIG. 7*d*, the position of the trigger lever 180 and the auxiliary-latch lever 170 are shown as the extension of the auxiliary latch 168 approaches the predetermined distance and the trigger lever 180 approaches the second trigger-lever position at which the release-lever engaging end 186 of the trigger lever 180 just clears the trigger engaging arm 164 of the release lever 160.

The resetting step 236 resets the trigger lever 180 to a triggering position (or first trigger lever position) when the auxiliary latch 168 has moved the predetermined distance. In the resetting step 236, upon clearing the release lever 160, the trigger lever 180 is pivoted to the triggering position under the applied force of the torsion spring 182 and abuts the stop 184 extending from the auxiliary-latch lever 170. Continued movement of the auxiliary latch 168 to the extended auxiliary-latch position returns the components of the deadbolt mechanism 100 to the configuration shown in FIG. 7*a*.

The releasing the deadbolt step 240 releases the deadbolt 104 from the retracted deadbolt position when the auxiliary latch 168 moves toward the retracted auxiliary-latch position from at least the predetermined distance from the retracted auxiliary-latch position. In the releasing step, the retraction of the auxiliary latch 168 by the strike plate causes the auxiliary-latch lever 170 to pivot in a counter clockwise direction. The trigger lever 180 abutted against the stop 184 pivots with the auxiliary-latch lever 170 causing the release lever 160 to pivot. The release lever 160, in turn, pivots the deadbolt holding lever 118 which then releases the deadbolt 104, allowing the deadbolt 104 to extend under the force applied to the deadbolt 104 by the deadbolt lever 114.

Those skilled in the art will appreciate that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An automatic deadbolt mechanism comprising:

a deadbolt movable between a retracted deadbolt position and an extended deadbolt position, the deadbolt biased in the extended deadbolt position;

an auxiliary latch movable between a retracted auxiliary-latch position and an extended auxiliary-latch position, the auxiliary latch biased in the extended auxiliary-latch position;

a trigger biased in a first trigger position and movable between the first trigger position and a second trigger position, the trigger operatively coupled to the deadbolt and to the auxiliary latch, the trigger configured to be in the first trigger position when the auxiliary latch is in the extended auxiliary-latch position and in the second trigger position when the auxiliary latch is in the retracted auxiliary-latch position, to cause a first movement of the deadbolt from the retracted deadbolt position to the extended deadbolt position when the trigger moves from the first trigger position to the second trigger position, and to require movement of the auxiliary latch a predetermined distance from the retracted auxiliary-latch position toward the extended auxiliary-latch position before the trigger is able to cause a second movement of the deadbolt;

a deadbolt holding lever biased in a first deadbolt holding-lever position and pivotable between the first deadbolt holding-lever position and a second deadbolt holding-lever position, the deadbolt holding lever configured to releasably retain the deadbolt in the retracted deadbolt position when the deadbolt holding lever is in the first deadbolt holding-lever position; and a release lever biased in a first release-lever position and pivotable between the first release-lever position and a second release-lever position, the release lever configured to cause the deadbolt holding lever to pivot from the first deadbolt-holding-lever position toward the second deadbolt-holding-lever position when the release lever pivots from the first release-lever position toward the second release-lever position, wherein the trigger is operatively coupled to the release lever and is configured to cause a first pivot of the release lever from the first release-lever position to the second release-lever position when the trigger pivots from the first trigger position to the second trigger position, and to require movement of the auxiliary latch a predetermined distance from the retracted auxiliary-latch position toward the extended auxiliary-latch position before the trigger is able to cause a second pivot of the release lever, and wherein the release lever has a trigger-lever engaging arm and the trigger comprises:

an auxiliary-latch lever pivotable between the first trigger position and the second trigger position, the auxiliary-latch lever biased in the first trigger position;

a stop extending from the auxiliary-latch lever; and a trigger lever pivotably connected to the auxiliary-latch lever, biased in a first trigger-lever position abutting the stop and pivotable between the first trigger-lever position and a second trigger-lever position, the trigger lever having a release-lever engaging end slideably engageable with the trigger-lever engaging arm.

2. The mechanism according to claim 1, wherein the trigger-lever engaging arm has a generally concave edge and the release-lever engaging end is beveled.

3. A method for automatically moving a deadbolt of a mortise lock assembly having an auxiliary latch operatively coupled to the deadbolt, an auxiliary-latch lever operatively coupled to the auxiliary latch and a trigger lever pivotably attached to the auxiliary-latch lever and operatively coupled to the deadbolt, the method comprising the steps of:

retracting the deadbolt from an extended deadbolt position to a retracted deadbolt position;

releasably retaining the deadbolt in the retracted deadbolt position;

preventing the deadbolt from being released from the retracted deadbolt position until the auxiliary latch has moved a predetermined distance from a retracted auxiliary-latch position toward an extended auxiliary-latch position, the preventing step further comprising:

pivoting the auxiliary-latch lever from a triggered (or second) auxiliary-latch lever position toward a triggering (or first) auxiliary-latch lever position as the auxiliary latch moves the predetermined distance;

allowing the trigger lever to pivot relative to the auxiliary-latch lever as the auxiliary-latch lever pivots from the triggered (or second) auxiliary-latch lever position toward the triggering (or first) auxiliary-latch lever position; and resetting the trigger lever to a triggering position (or first trigger lever position) when the auxiliary latch has moved the predetermined distance, and releasing the deadbolt from the retracted deadbolt position when the auxiliary latch moves toward the retracted auxiliary-latch position from at least the predetermined distance from the retracted auxiliary-latch position.

* * * * *